United States Patent [19]

Abthoff et al.

[11] 3,988,890

[45] Nov. 2, 1976

[54] OVERHEATING PROTECTION FOR AN EXHAUST GAS PURIFICATION BLOCK

[75] Inventors: Jorg Abthoff, Pluderhausen; Dag-Harald Huttebraucker, Endersbach; Gunter Loose, Kemnat, all of Germany

[73] Assignee: Daimler-Benz Aktiengesellschaft, Germany

[22] Filed: Mar. 3, 1975

[21] Appl. No.: 554,689

[30] Foreign Application Priority Data

Mar. 5, 1974 Germany ..... 2410417

[52] U.S. Cl. ..... 60/274; 23/288 FA; 60/277; 60/288; 423/212

[51] Int. Cl.[2] ..... F01N 3/15

[58] Field of Search ..... 60/288, 277, 287, 274; 23/288 FA; 423/212

[56] References Cited

UNITED STATES PATENTS

| | | | |
|---|---|---|---|
| 2,807,933 | 10/1957 | Martin | 60/39.23 |
| 3,144,309 | 8/1964 | Sparrow | 60/288 |
| 3,282,046 | 11/1966 | Walker | 60/288 |
| 3,813,226 | 5/1974 | Heitland | 60/287 |

FOREIGN PATENTS OR APPLICATIONS

| | | | |
|---|---|---|---|
| 1,948,777 | 4/1970 | Germany | 60/288 |

*Primary Examiner*—Douglas Hart
*Attorney, Agent, or Firm*—Craig & Antonelli

[57] ABSTRACT

A method and apparatus for preventing an overheating of an exhaust gas purification block for internal combustion engines in case of a high proportion of combustible gas components in the exhaust gases, in which the exhaust gases are adapted to be conducted past the exhaust gas purification block by way of a controllable by-pass line; at least during the periods when the by-pass line is opened, air preferably in the form of an air jet directed opposite to the normal exhaust gas flow is blown into the line leading into the exhaust gas purification block whereby preferably the air jet passes over the inlet opening of the exhaust gas purification block in a transverse direction.

26 Claims, 1 Drawing Figure

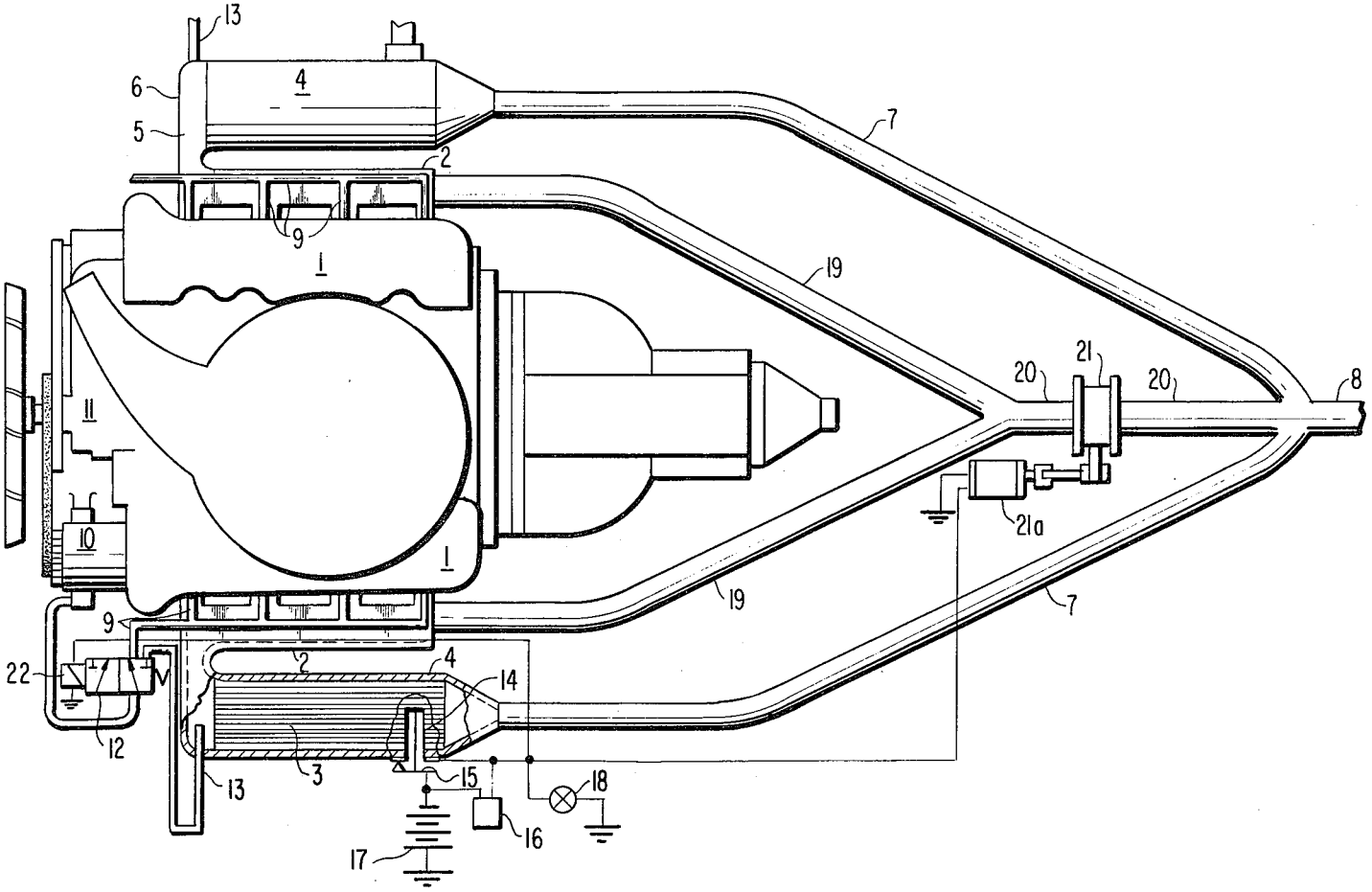
8
20
21
20
21a
7
7
19
19
18
16
14
15
4
2
1
1
4
9
2
3
13
13
6
5
9
12
11
10
22
17

OVERHEATING PROTECTION FOR AN EXHAUST GAS PURIFICATION BLOCK

The present invention relates to a method for preventing an overheating of an exhaust gas purification or decontamination block for internal combustion engines in case of a high proportion in combustible gas components in the exhaust gas, whereby the exhaust gas is conducted past the exhaust gas purification block by way of a controllable by-pass line. Additionally, the present invention also relates to an internal combustion engine with at least one exhaust gas purification block arranged in the exhaust gas line, preferably in proximity of the engine, for the catalytic after-treatment of the exhaust gases of the internal combustion engine, with a by-pass line for the exhaust gas by-passing the exhaust gas purification block or blocks and controllable preferably by a valve or flap and with a branching place of the exhaust gas line upstream of the exhaust gas purification block into an exhaust gas channel leading at least indirectly to the exhaust gas purification block and into an exhaust gas channel passing over into the by-pass line as well as with an installation to introduce air into the exhaust gas channel upstream of the exhaust gas purification block.

Such types of engines are known in the art. The exhaust gas purification or decontamination block may be constructed as so-called monolith or as granular or fibrous mass. The exhaust gas treatment may take place in one stage or in two stages. All of these possibilities are to be encompassed by reference to the aforementioned internal combustion engine.

The known by-pass systems controllable by flaps, valves or the like in the exhaust gas after-treatment serve as overheating protection of the exhaust gas purification or decontamination installations which are sensitive in case of a high proportion of combustible residues in the engine exhaust gases. With an open by-pass, however, a partial stream of "combustible" exhaust gases which might possibly still thermally load the exhaust gas purification block excessively, may pass through the exhaust gas purification block corresponding to the flow resistances in the individual line connections insofar as the "clean" exhaust gas connection is not also controlled by a valve or flap arranged upstream of the exhaust gas purification block. This double-control of the main-connection and of the by-pass connection, however, becomes very complicated, especially with engines having two cylinder rows.

It is the aim of the present invention to provide a method and structural solution, on the basis of which an overheating of the exhaust gas purification or decontamination block can be avoided in a reliable manner by simple means in case of a spark plug failure or similar operating conditions.

According to the present invention, one proceeds as solution to this task in that at least during the opening periods of the by-pass line, air, preferably in the form of at least one air jet directed opposite of the normal exhaust gas flow is blown into the line leading to the exhaust purification block, whereby preferably the air jet or air jets pass transversely over the inlet aperture of the exhaust gas purification block. In that connection approximately an air volume of about 20% to about 30% of the rate of air flow of the combustion engine may be blown in.

Structurally, the underlying problems are solved according to the present invention in that an air supply place is provided at the branching place and/or at a place of the channel leaading to the exhaust gas purification block, which is located downstream of the branching place as viewed in the flow direction, and in that the inlet opening or openings for the air is or are so constructed that the supplied air is focused or concentrated into at least one jet, and in that it is or they are further so arranged and constructed that a flow of the exhaust gases into the branch channel leading to the purification block is prevented by the air jet or jets and/or a flow of the exhaust gas into the branch channel passing over into the by-pass line is favored.

A damming-up or back-pressure effect is achieved for the partial exhaust gas stream by the air jet directed opposite to the flow direction of the exhaust gas partial stream with an opened by-pass line so that fewer exhaust gases reach the exhaust gas purification block. However, as a result of this air supply at the inlet of the exhaust gas purification block, on the one hand, the exhaust gas is strongly thinned out and cooled off by the admixture of cold thinning air and, on the other, the flow velocity through the exhaust gas purification block is considerably increased compared to the original nearly stagnating exhaust gas stream. The air supply according to the present invention therefore has as a consequence two influences which become effective in the final analysis in a temperature-decreasing manner, namely: a reduction of the remaining exhaust gas partial stream through the exhaust gas purification block by reason of a back pressure or damming up as well as a thinning of the exhaust gases and a cooling off. These two influences bring about in the result a very rapid decrease of the temperature of the exhaust gas purification block up to a point below the ignition temperature thereof; even if the heating or thermal value of the exhaust gas air-mixture passing through the exhaust gas purification block should thus suffice so as to cause theoretically an overheating of the exhaust gas purification block, this is precluded by reason of the cooling off of the exhaust gas purification block below its ignition temperature. Only by a turning off of the blown-in air and/or by a closing of the by-pass line, the exhaust gas purification block could be heated to its ignition temperature by reason of the high exhaust gas temperatures and could then again operate as contemplated.

A temperature sensor may be arranged advantageously at the exhaust gas purification block and means may be provided such that upon exceeding the rated temperature at the temperature sensor, the air supply is turned on at least indirectly and is otherwise turned off.

Frequently, in internal combustion engines, in addition to the aforementioned air supply (second air requirement place), a further air supply (first air requirement place) is additionally provided which terminates in the exhaust gas channels within the direct area of each outlet of the exhaust gas out of each working chamber. In order to enable with such engines an air supply according to the present invention with simplest possible means in case of need, it is appropriate if the same pressure source is used for both air requirement places and if the air requirement places are adapted to be individually connected alternatively with the pressure source according to indication of the temperature sensor. The two air requirement places may thereby be connected to the pressure source by way of a branch line, and a shifting valve may be arranged at the branching place of the branch line, which is actuated at least indirectly by the temperature sensor.

The damming up or back-pressure effect of the blown-in air can be achieved in that the line leading to the exhaust gas purification block includes directly upstream of the entry into the exhaust gas purification block, an elbow member and a rectilinearly extending line section upstream thereof, and in that an air injection line which is rectilinear at least in the last portion and is disposed approximately coaxially to the rectilinear exhaust gas line section terminates in the elbow member, whose jet is directed opposite to the flow direction of the exhaust gas upstream of the elbow member; the discharge aperture of the air injection line may thereby be so arranged that the air jet extends into the exhaust gas purification block upstream of the inlet aperture. As a result thereof, a large amount of injected or blown-in air can enter the exhaust gas purification block.

Accordingly, it is an object of the present invention to provide an overheating protection for an exhaust gas purification block which avoids by simple means the aforementioned shortcomings and drawbacks encountered in the prior art.

Another object of the present invention resides in an overheating protection for an exhaust gas purification block which operates reliably to protect the exhaust gas purification or decontamination structure against overheating, even when the by-pass line is opened.

A further object of the present invention resides in an overheating protection of the type described above which is relatively simple in structure even if used with V-type engines.

A still further object of the present invention resides in an overheating protection for an exhaust gas purification block which prevents an overheating of the exhaust gas purification block in case of failure of a spark plug or of similar operating conditions.

These and further objects, features, and advantages of the present invention will become more apparent from the following description when taken in connection with the accompanying drawing which shows, for purposes of illustration only, one embodiment in accordance with the present invention, and wherein:

The single FIGURE is a somewhat sschematic plan view of a V-type internal combustion engine with an exhaust gas purification system according to the present invention for both cylinder rows, each provided with a by-pass line.

Referring now to the single figure of the drawing, in the illustrated V-engine 11, the cylinder heads which cover the two cylinder rows are each designated by reference numeral 1 while the exhaust gas manifolds flangedly connected thereto are designated by reference numeral 2 and the catalyst housings accommodating the exhaust gas purification or decontamination blocks 3 are designated by reference numeral 4. The exhaust gas stream of each cylinder row normally passes through the common exhaust pipe or manifold 2 into the catalyst housing 4 by way of the intermediate pipe 5 and the elbow member 6. While flowing through the exhaust gas purification block 3, the exhaust gases and the air excess are completely oxidized by reason of the catalytically effective material applied to the surface of the block and thus harmful, incompletely combusted exhaust gas components are eliminated. The purified exhaust gases then reach the atmosphere by way of the exhaust gas lines 7 and 8.

Air lines 9 terminate in the exhaust gas channels within the area of the discharge place of the exhaust gases out of the working space (not shown) of the engine, which air lines are supplied from an air pump 10 —driven by the V-engine 11. A shifting valve 12 is arranged in the pressure connection of the air pump 10, by means of which the air stream can be shifted selectively into the injection or blowing-in line 13 terminating in the exhaust gas elbow member 6. The air injection or blowing-in line 13 is disposed approximately coaxially with the intermediate pipe 5 so that the air jet flowing out of the blowing-in line 13 is directed exactly opposite to the exhaust gas stream flowing through the intermediate pipe 5 and is able to exert thereon a damming-up or backing-up action.

The exhaust gas manifold 2 of each cylinder row is adapted to be connected with the exhaust gas pipe 8 terminating in the atmosphere, by way of a by-pass line 19 and 20 and by way of a throttle valve closed in the normal condition so that the exhaust gases are able to be conducted into the atmosphere possibly past the catalyst and non-purified.

A temperature sensor 14 is mounted at the downstream end of the exhaust gas purification block 3, i.e., at the end most strongly endangered as regards an overheating, on the inside thereof, which upon exceeding the temperature, is able to close a switch 15 by reason of the thermal expansion. The switch 15 is adapted to be by-passed by a self-holding relay 16 so that the switched condition of the switch 15 remains preserved in the end effect also in case of a decrease of the temperature after a one-time response of the temperature sensor 14. A number of electrical loads are connected by the closing of the switch 15 at the temperature sensor 14 with the power supply fed by the battery 17 of the corresponding vehicle. The control lamp 18 should be mentioned at first which is mounted within the field of vision of the driver and which signals to him the need for a visit to the workshop. Furthermore, the actuating magnet 21a for the by-pass flap 21 is adapted to be engaged by the switch 15 so that the flap 21 and the by-pass line 19, 20 are opened. Additionally, as a result of the closing of the switch 15, the actuating magnet 22 of the valve 12 is energized so that by reason of the new valve position, the air lines 9 are separated from the air supply and in lieu thereof, the blow-in lines 13 are connected to the air pump 10.

By reason of the blowing-in of the air at the elbow member 6 opposite the flow direction of the exhaust gas, only a very small non-harmful quantity of exhaust gas is conducted by way of the catalysts 3 with an opened by-pass line by reason of the damming-up action of the air jet and in lieu thereof, a thinned-out air component which is effective in a cooling manner, is forced therethrough.

An overheating danger of the catalyst exists if after an orderly starting of the exhaust gas purification system, the exhaust gases contain an excessive amount of combustible components. This may be the case, for example, in case of failure of a spark plug which, in its turn, may have as its cause various small damages, for example, breakage of the ignition cable, defect of the spark plug or of the spark plug holder. In such cases, the temperature in the catalyst rises above the response temperature of the temperature sensor by reason of the high remaining gasoline proportion. This causes then an opening of the by-pass line and an effective aerodynamic closure of the normal exhaust gas path by way of the catalyst, caused by the injection or blowing-in of air. The driver is informed of the failure by the warning lamp 18. The high-degree air thinning of the residual exhaust gases reaching the catalyst and the high proportion of relatively cold fresh air cools down rapidly the overheated catalyst so that the latter has assumed a high temperature only for a short period of time, which it can still accept without damages.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A method for preventing an overheating of an exhaust gas purification block for internal combustion engines in case of a high proportion in combustible gas components in the exhaust gases, in which the exhaust gases are conducted past the exhaust gas purification block by way of a controllable by-pass line, comprising the step of blowing-in air at least during the opening periods of the by-pass line into a line leading to the exhaust gas purification block, the air is blown into the line leading to the exhaust gas purification block in the form of at least one air jet directed opposite the normal exhaust gas flow through said line, and the air jet passes transversely over the inlet opening of the exhaust gas purification block.

2. A method according to claim 1, characterized in that an air volume of about 20 to 30% of the rate of air flow of the internal combustion engine is blown into the line leading to the exhaust gas purification block.

3. A method for preventing an overheating of an exhaust gas purification block for internal combustion engines in case of a high proportion in combustible gas components in the exhaust gases, in which the exhaust gases are conducted past the exhaust gas purification block by way of a controllable by-pass line, comprising the step of blowing-in air at least during the opening periods of the by-pass line into a line leading to the exhaust gas purification block, an air volume of about 20 to 30% of the rate of air flow of the internal combustion engine is blown into the line leading to the exhaust gas purification block, and the air is blown into the line leading to the exhaust gas purification block in the form of at least one air jet directed opposite the normal exhaust gas flow through said line.

4. A system for preventing overheating of an exhaust gas purification block for an internal combustion engine in case of a high proportion in combustible gas proponents in the exhaust gases, the system comprising: and exhaust line means for directing flow of exhaust gases from the internal combustion engine to the exhaust gas purification block, a by-pass line means for conducting the flow of exhaust gases past the exhaust gas purification block in a by-passing relation thereto, control means for controlling opening and closing of said by-pass line means, and air injecting means for blowing air into the exhaust line means in a direction opposite the normal direction of exhaust gas flow in the exhaust line means at least when said by-pass line is open whereby the blown-in air from said air injecting means exerts a damming-up force on the exhaust gas flow in the exhaust line means so that only a small quantity of thinned-out exhaust gases are directed through the exhaust gas purification block.

5. The system according to claim 4, wherein said air injecting means is operable to blow-in the air into said exhaust line means in the form of at least one air jet.

6. The system according to claim 5, wherein the air is blown into said line means in the form of several jets.

7. The system according to claim 5, wherein the exhaust gas purification block includes an inlet opening disposed substantially transversely to the direction of flow of the exhaust gases in said exhaust line means, and wherein each air jet flows past the inlet opening to the exhaust gas purification block in a substantially transverse manner.

8. The system according to claim 7, wherein an air volume of about 20 to 30% of the rate of air flow of the internal combustion engine is blown into said exhaust line means by said air-injecting means.

9. The system according to claim 4, wherein an air volume of about 20 to 30% of the rate of air flow of the internal combustion engine is blown into said line means by said air-injecting means.

10. An internal combustion engine comprising: an exhaust gas line means for directing the flow of exhaust gases from the internal combustion engine, and exhaust gas purification block arranged at the exhaust gas line means for effecting a catalytic after-treatment of the exhaust gases, a by-pass line means for by-passing the exhaust gas purification block, control means for controlling opening and closing of said by-pass line means, a branching means in the exhaust gas line means upstream of the exhaust gas purification block for branching the exhaust gas line means into a first exhaust gas channel means at least indirectly leading to the exhaust gas purification block and into a second exhaust gas channel means passing over into the by-pass line means, an air supply means including air aperture means for concentrating supplied air into at least one jet of air, said aperture means being so arranged and aligned so as to direct said at least one jet of air in a direction opposite a normal direction of flow of the exhaust gases in the first exhaust gas channel means leading to the exhaust gas purification block whereby the flow of exhaust gases from said first exhaust gas channel means to the exhaust gas purification block is prevented by said at least one jet of air.

11. An internal combustion engine accoring to claim 13, wherein said air supply means is provided at one of the two places consisting of the branching means and at a place of the first exhaust gas channel means leading to the exhaust gas purification block disposed downstream of the branching means as viewed in the exhaust gas flow direction.

12. An internal combustion engine according to claim 11, wherein the force of the jet of air is such that a flow the exhaust gases into the branch channel means passing over into the by-pass line means is favored.

13. An internal combustion engine according to claim 12, wherein the exhaust gas purification block is arranged in proximity to the internal combustion engine.

14. An internal combustion engine according to claim 13, wherein said control means includes a flap means disposed in said by-pass line means.

15. An internal combustion engine according to claim 14, wherein the air supply means includes means for producing several air jets.

16. An internal combustion engine according to claim 11, wherein said air supply means is normally turned off, further comprising: a temperature sensor means arranged at the exhaust gas purification block, and means connected with said temperature sensor means for a least indirectly turning on the air supply means upon exceeding a rated temperature at the temperature sensor means.

17. An internal combustion engine according to claim 16, wherein the internal combustion engine includes at least one working chamber having at least one discharge opening for discharging exhaust gases into at least one exhaust gas channel communicating with the exhaust gas line means, further comprising: a further air supply means disposed within the direct area of the at least one discharge opening, a common pressure source means for both air supply means, and means for connecting both air supply means alternatively and individually to the common pressure source means according to the indication of the temperature sensor means.

18. An internal combustion engine according to claim 17, wherein said connecting means includes a branch line and a shifting valve means arranged at the branch line, the shifting valve means being actuated at least indirectly by the temperature sensor means.

19. An internal combustion engine which includes at least one working chamber having at least one discharge opening for discharging exhaust gases into at least one exhaust gas channel, comprising: and exhaust gas line means for directing the flow of exhaust gases from the at least one exhaust gas channel of the internal combustion engine, an exhaust gas purification block for effecting a catalytic aftertreatment of the exhaust gases, an exhaust gas inlet means for communicating the exhaust gas purification block with the exhaust gas line means, a by-pass line means for by-passing the exhaust gas purification block, control means for controlling opening and closing of said by-pass line means, a branching means in the exhaust gas line means upstream of the exhaust gas purification block for branching the exhaust gas line means into a first exhaust gas channel means at least indirectly leading to the exhaust gas purification block and into a second exhaust gas channel means passing over into the by-pass line means, a normally off air supply means including air aperture means for oncentrating supplied air into at least one jet of air, said air supply means being provided at one of two places consisting of the branching means and at a place of the first exhaust gas channel means leading to the exhaust gas purification block disposed downstream of the branching means as viewed in the exhaust gas flow direction, a temperature sensor means arranged at the exhaust gas purification block, means connected with said temperature sensor means for at least indirectly turning on the air supply means upon exceeding a rated temperature at the temperature sensor means, a further air supply means disposed within the direct area of the at least one discharege opening, a common pressure source means for both air supply means, means for connecting both air supply means alternatively and individually to the common pressure source means according to the indication of the temperature sensor means including a branch line and a shifting valve means arranged at the branch line actuated at least indirectly by the temperature sensor means, said first exhaust gas line means including an elbow member disposed directly in front of the exhaust gas inlet means of the exhaust gas purification block and a rectilinearly extending line section, said air supply means including an air injection line terminating in the rectilinearly extending line section of said first exhaust gas line means, at least a terminal portion of said air injection line being rectilinear and being disposed approximately coaxially to the rectilinearly extending section of the exhaust gas line means, said air injection line terminates in said air aperture means in the elbow member and directs the jet of air opposite the flow direction of the exhaust gases upstream of the elbow member so that a flow of exhaust gases into the exhaust gas purification block is prevented by the jet of air.

20. An internal combustion engine according to claim 19, wherein said air aperture means of the air injection line is arranged with the jet of air extending in front of the exhaust gas inlet means of the exhaust gas purification block.

21. An internal combustion engine comprising: an exhaust gas line means for directing the flow of exhaust gases from the internal combustion engine, an exhaust gas purification block for effecting a catalytic aftertreatment of the exhaust gases arranged at the exhaust gas line means, an exhaust gas inlet means for communicating the exhaust gas purification block with the exhaust gas line means, a by-pass line means for by-passing the exhaust gas purification block, control means for controlling the opening and closing of the by-pass line means, a branching means in the exhaust gas line means upstream of the exhaust gas purification block for branching the exhaust gas line means into a first exhaust gas channel means at least indirectly leading to the exhaust gas purification block and into a second exhaust gas channel means passing over into the by-pass line means, an air supply means including air aperture means for concentrating supplied air into at least one jet of air, said first exhaust gas line means including an elbow member disposed directly in front of the exhaust gas inlet means of the exhaust gas purification block and a rectilinearly extending line section, said air supply mean including an air injection line terminating in the rectilinearly extending line section of said first exhaust gas line means, at least a terminal portion of said air injection line being rectilinear and being disposed approximately coaxially to the rectilinearly extending section of the exhaust gas line means, said air injection line terminates in said air aperture means in the elbow member and directs the jet of air opposite the flow direction of the exhaust gases upstream of the elbow member so that a flow of exhaust gases into the exhaust gas purification block is prevented by the jet of air.

22. An internal combustion engine comprising: an exhaust gas line means for directing the flow of exhaust gases from the internal combustion engine, an exhaust gas purification block for effecting a catalytic aftertreatment of the exhaust gases arranged at the exhaust gas line means, an exhaust gas inlet means for communicating the exhaust gas purification block with the exhaust gas line means, a by-pass line means for by-passing the exhaust gas purification block, control means for controlling opening and closing of the bypass line means, a branching means in the exhaust gas line means upstream of the exhaust gas purification block for branching the exhaust gas line means into a first gas channel means at least indirectly leading to the exhaust gas purification block and into a second exhaust gas channel means passing over into the bypass line means, an air supply means including air aperture means for concentrating supplied air into at least one jet of air, the air aperture means of the air injection line being arranged with the air jet extending in front of the exhaust gas inlet means of the exhaust gas purification block whereby a flow of exhaust gases into the exhaust gas purification block is prevented by the jet of air.

23. A method of preventing an overheating of an exhaust purification arrangement of an internal combustion engine, the method comprising the steps of:

providing a by-pass line for by-passing the exhaust purification arrangement;

selectively controlling opening and closing of the by-pass line;

providing an exhaust line communicating the internal combustion engine with the by-pass line and the exhaust purification arrangement such that a flow of exhaust gases has a normal flow direction from the internal combustion engine through the exhaust line to the exhaust purification arrangement;

providing at least one jet of air; and directing the flow of the at least one jet of air into the exhaust line in a direction opposite the normal direction of flow of the exhaust gases in the exhaust line at least when the bypass line is open to prevent the flow of exhaust gases from the exhaust line into the exhaust purification arrangement.

24. A method according to claim 23, wherein the step of selectively controlling opening and closing of the by-pass line includes:

providing a temperature sensor at the exhaust purification arrangement;

providing a by-pass line control element responsive to signals from the temperature sensor; and opening the by-pass control element in response to the temperature sensor providing a signal indicative of an exceeding of a rated temperature at the exhaust purification arrangement.

25. A method according to claim 24, wherein the step of providing an exhaust line includes:

disposing at least a portion of the exhaust line so as to extend transversely of an inlet opening to the exhaust gas purification arrangement.

26. An internal combustion engine comprising: an exhaust gas purification means for effecting a catalytic after-treatment of exhaust gases of the internal combustion engine, an exhaust gas line means communicating with said exhaust gas purification means for directing the flow of exhaust gases from the internal combustion engine to the exhaust gas purification means, a by-pass line means communicating with said exhaust gas line means for by-passing said exhaust gas purification means, means for selectively opening and closing said by-pass line means in response to the existence of a given condition at the exhaust gas purifying means, means for supplying at least one jet of air, and means for mounting said supplying means at the exhaust gas line means so that said at least one jet of air is directed in a direction opposite a normal flow direction of exhaust gases in the exhaust gas line means whereby a flow of exhaust gases from the exhaust gas line means into the exhaust gas purification means is prevented by the jet of air at least when said by-pass line means is opened by said control means.

* * * * *